US008960056B2

(12) United States Patent
Lee

(10) Patent No.: US 8,960,056 B2
(45) Date of Patent: Feb. 24, 2015

(54) FOLDABLE WRENCH

(71) Applicant: Yi-Min Lee, Taichung (TW)

(72) Inventor: Yi-Min Lee, Taichung (TW)

( * ) Notice: Subject to any disclaimer, the term of this patent is extended or adjusted under 35 U.S.C. 154(b) by 211 days.

(21) Appl. No.: 13/763,665

(22) Filed: Feb. 9, 2013

(65) Prior Publication Data

US 2014/0224081 A1 Aug. 14, 2014

(51) Int. Cl.

| | |
|---|---|
| ***B25B 13/00*** | (2006.01) |
| ***B25B 23/16*** | (2006.01) |
| ***B25G 1/06*** | (2006.01) |
| ***B25B 13/08*** | (2006.01) |
| ***B25B 13/46*** | (2006.01) |
| ***B25B 13/48*** | (2006.01) |

(52) U.S. Cl.

CPC ..... *B25G 1/063* (2013.01); *B25B 13/08* (2013.01); *B25B 13/461* (2013.01); *B25B 13/481* (2013.01)

USPC ..... 81/177.8; 81/177.7

(58) Field of Classification Search

USPC ..... 81/177.6, 177.7, 177.8, 177.9

See application file for complete search history.

(56) References Cited

U.S. PATENT DOCUMENTS

| | | | | |
|---|---|---|---|---|
| 6,161,982 | A * | 12/2000 | Cole | 403/97 |
| 6,216,565 | B1 * | 4/2001 | McCann | 81/177.8 |
| 7,246,545 | B1 * | 7/2007 | Lee | 81/177.9 |
| 7,302,876 | B1 * | 12/2007 | Lee | 81/177.9 |

* cited by examiner

*Primary Examiner* — David B Thomas

(57) ABSTRACT

A foldable wrench includes a lever, a handle, a lock and a key. The lever includes two lugs each including an opening defined therein. The first lug includes teeth formed on the wall of the opening. The handle includes a lug including an opening defined therein and teeth formed on the wall of the opening. The lug of the handle is placed between the lugs of the lever. The lock includes teeth formed thereon. The lock is movable between a releasing position to engage the teeth of the lock with the teeth of the handle only and a locking position to engage the teeth of the lock with the teeth of the handle and the teeth of the lever. The key is rotatable on the second lug of the lever between a first position corresponding to the releasing position and a second position corresponding to the locking position.

12 Claims, 9 Drawing Sheets

FOLDABLE WRENCH

BACKGROUND OF INVENTION

1. Field of Invention

The present invention relates to a wrench and, more particularly, to a foldable wrench.

2. Related Prior Art

A conventional wrench is not foldable no matter it is straight, arched or bent. Sometimes, it is difficult to use such a conventional wrench in a limited space.

As disclosed in Taiwanese Patent Publication Nos. 450185 and 569860 and Taiwanese Patents 1241940 and 1242483, a foldable wrench includes a head pivotally connected to a handle. To adapt the wrench to a limited space, the handle is pivoted relative to the head about a first axis. To drive a fastener such as screw, the handle is locked at a desired angle relative to the head, and the handle is operated to rotate the head about a second axis extending perpendicular to the first axis. The pivoting of the handle relative to the head to adapt to the limited space is independent of the pivoting of the handle and the head about the second axis to rotate the fastener. To pivot the head about the second axis for a large angle, the handle has to be pivoted about the second axis for the same angle, and this is often difficult in the limited space.

As disclosed in U.S. Pat. Nos. 7,246,545 and 7,302,876 issued to the present applicant, a foldable selectively one-way wrench includes a handle, a lever, a gear and a selectively one-way wrench. The lever is pivotally connected to the handle. The gear is rotationally placed in the lever. The selectively one-way rotating unit is arranged between the gear and the lever. The handle can be pivoted relative to the lever about a first axis. With the selectively one-way rotating unit, the gear is rotated together with or relative to the lever about a second axis extending parallel to the first axis. The pivoting of the handle relative to the lever about the first axis can be executed to bring about the pivoting of the lever about the second axis. That is, the handle can be substantially moved to and fro to pivot the lever to and fro. In some limited spaces, this is very useful. However, there is still room for improvement of the connection of the lever to the handle.

Therefore, the present invention is intended to obviate or at least alleviate the problems encountered in prior art.

SUMMARY OF INVENTION

It is the primary objective of the present invention to provide a convenient foldable wrench.

To achieve the foregoing objective, the foldable wrench includes a lever, a handle, a lock and a key. The lever includes two lugs each including an opening defined therein. The first lug includes teeth formed on the wall of the opening. The handle includes a lug including an opening defined therein and teeth formed on the wall of the opening. The lug of the handle is placed between the lugs of the lever. The lock includes teeth formed thereon. The lock is movable between a releasing position to engage the teeth of the lock with the teeth of the handle only and a locking position to engage the teeth of the lock with the teeth of the handle and the teeth of the lever. The key is rotatable on the second lug of the lever between a first position corresponding to the releasing position and a second position corresponding to the locking position.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
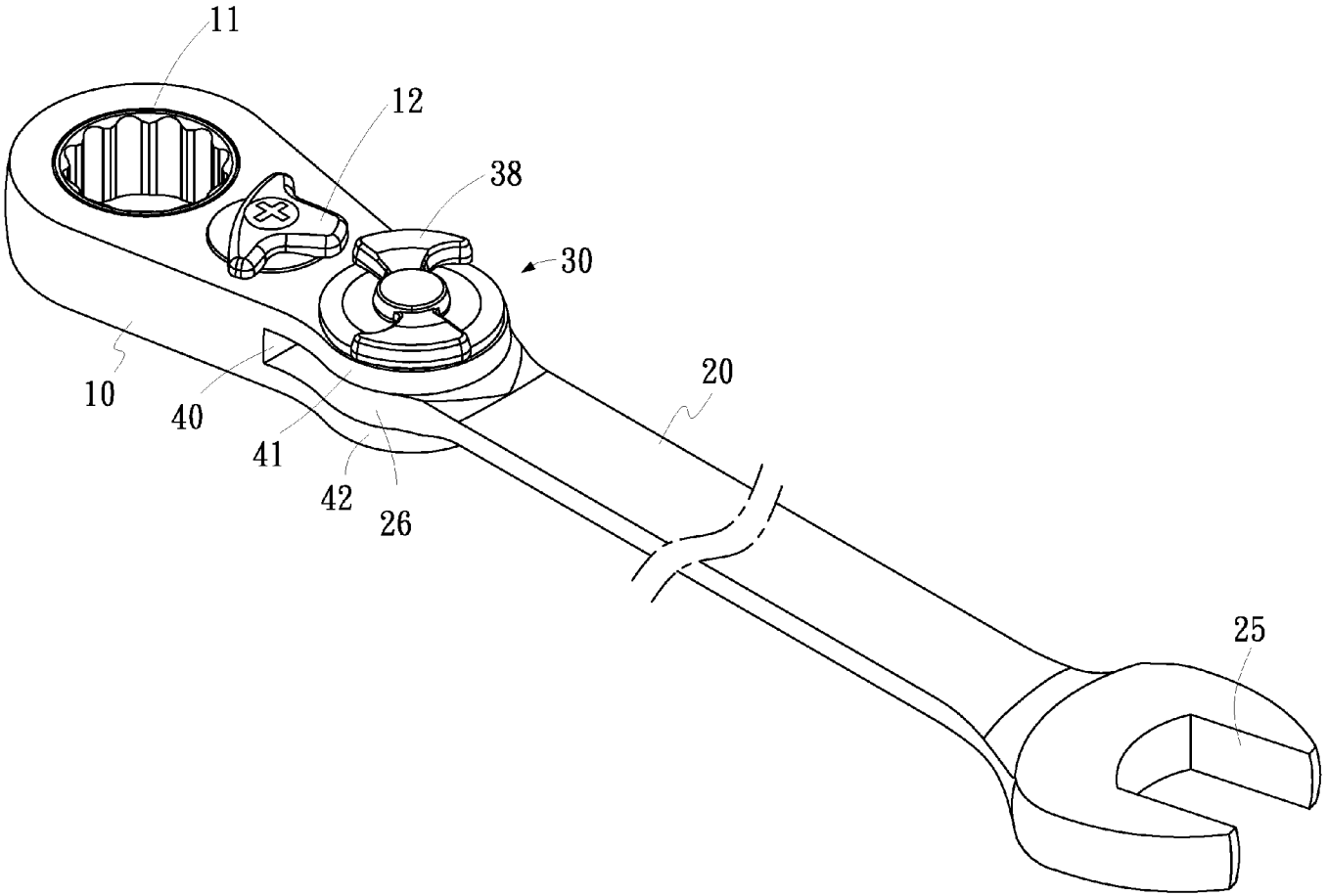
FIG. 1 is a perspective view of a foldable wrench according to the preferred embodiment of the present invention.
Figure 2:
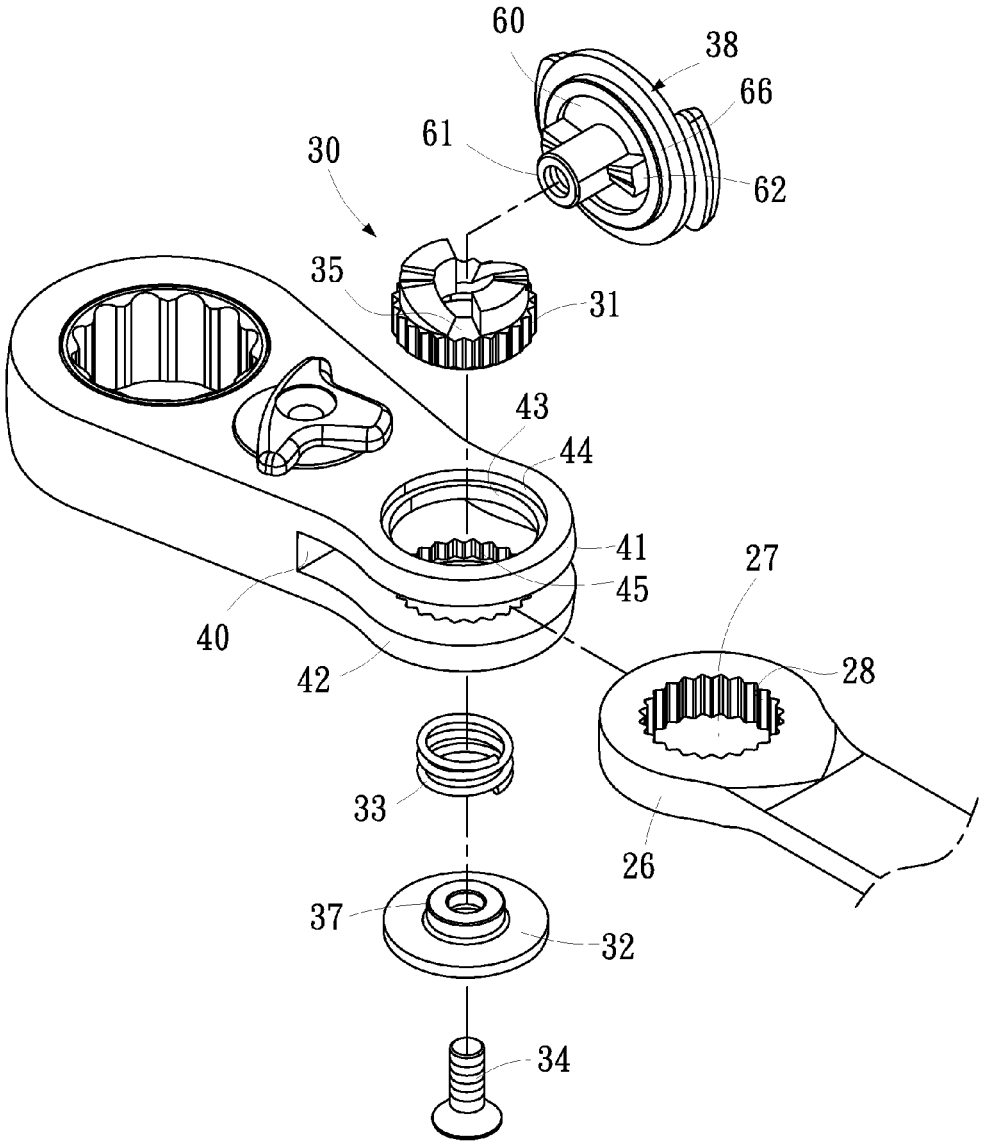
FIG. 2 is an exploded view of the foldable wrench shown in FIG. 1.

Referring to FIGS. 1 and 2, there is shown a foldable wrench according to the preferred embodiment of the present invention. The wrench includes a lever 10, a handle 20 and a positioning device. The positioning device includes a lock 30, a key 38, a disc 32, a spring 33 and a screw 34.

The lever 10 includes a head at an end and two lugs 41 and 42 at another end. A gear 11 is rotationally placed in the head of the lever 10. A switch 12 is pivotally placed on the lever 10. A selectively one-way rotating unit (not shown) is between the gear 11 and the lever 10. By operating the switch 12, the gear 11 is rotated by the lever 10 as the lever 10 is pivoted in one of two directions left still when the lever 10 is pivoted in the other direction.

Referring to FIG. 2, the lug 41 includes two openings 43 and 44 in communication with each other. The opening is 43 smaller than the opening 44 so that there is an annular shoulder between them. Similarly, the lug 42 includes two openings 43 and 44. The openings 43 are placed closer to each other than the openings 44. There are teeth 45 formed on the wall of the opening 43 of the lug 42.

The handle 20 includes a head 25 at an end and a lug 26 at another end. The head 25 is a box end. The head 25 may be an open end. The lug 26 includes an opening 27 defined therein. There are teeth 28 formed on the wall of the opening 27. Preferably, the opening 27 is made corresponding to the opening 43, and the teeth 28 are shaped corresponding to the teeth 45.

Figure 3:
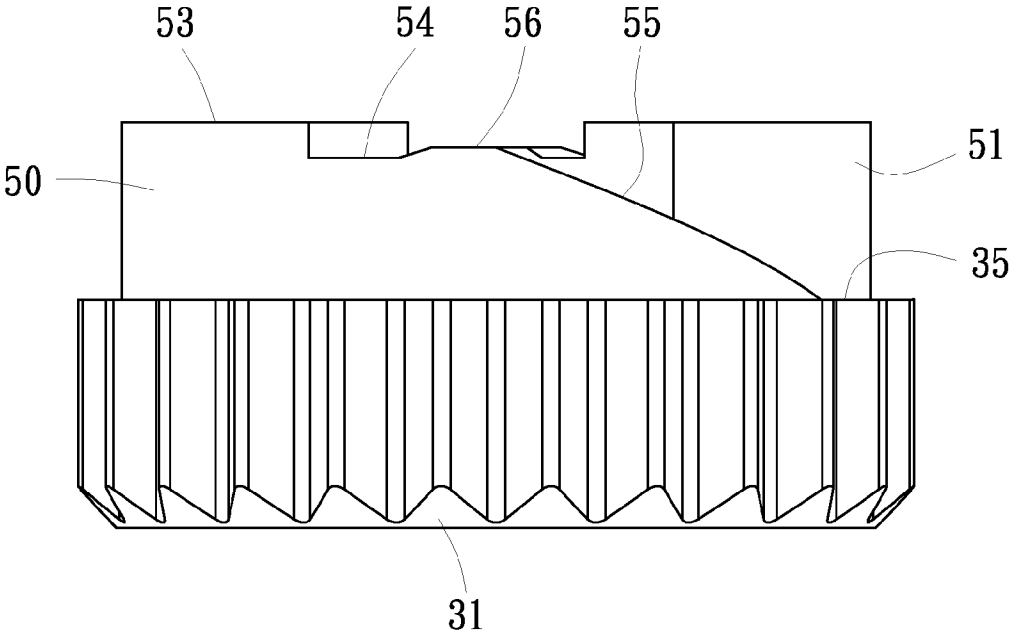
FIG. 3 is a front view of a lock used in the foldable wrench shown in FIG. 1.

Referring to FIGS. 2 and 3, the lock 30 includes teeth 31 and two wedges 50. The teeth 31 are formed on the periphery of the lock 30. The teeth 31 are formed corresponding to the teeth 28 and 45.

The wedges 50 are formed on a face 35 of the lock 30. Each of the wedges 50 includes three flat faces 52, 53 and 54 and two slopes 55 and 56. The flat face 54 is placed lower than the flat face 52, which is lower than the flat face 53. The slope 55 rises from the face 35 to the flat face 52. The slope 56 descends from the flat face 52 to the flat face 54. There is a shoulder between the flat faces 55 and 53.

Figure 4:
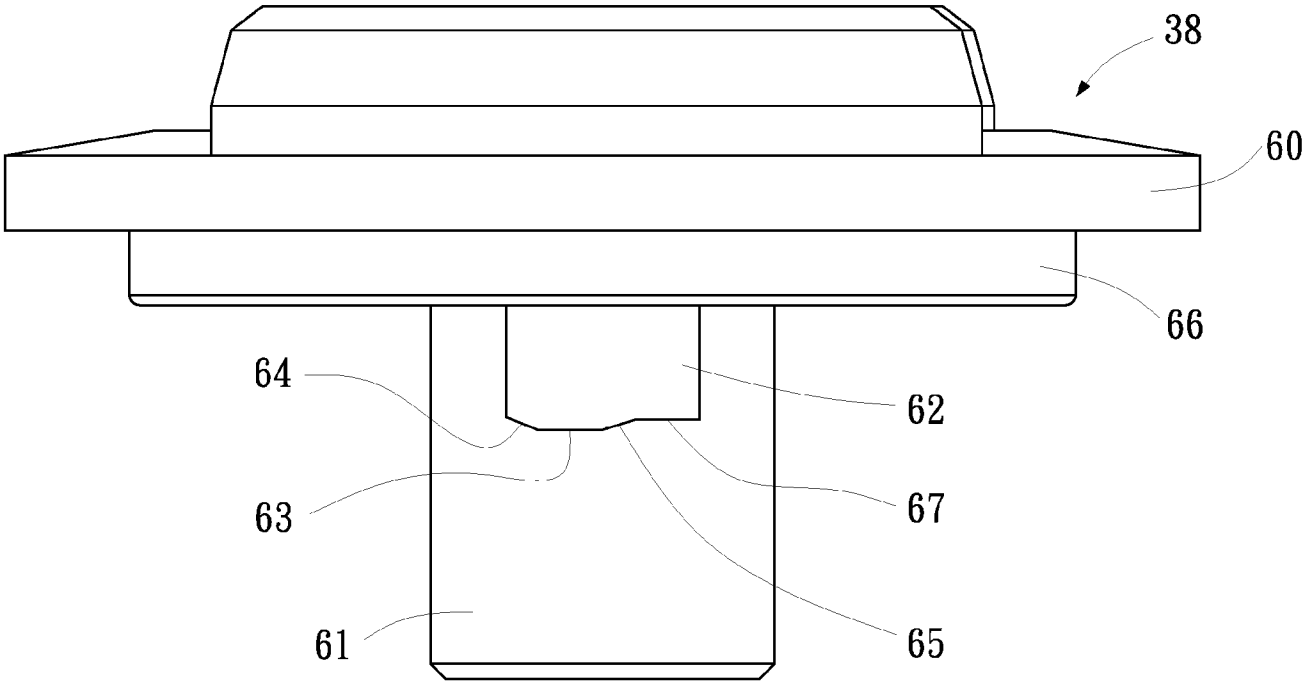
FIG. 4 is a front view of a key used in the foldable wrench shown in FIG. 1.

Referring to FIGS. 2 and 4, the key 38 includes a maneuver portion, a disc 60, a hub 61, two blocks 62 and a rib 66. The maneuver portion of the key 38 extends from an upper face of the disc 60. The blocks 62 and the rib 66 extend from a lower face of the disc 60. The hub 61 is placed in the center of a circle in which the rib 66 extends. Each of the blocks 62 is placed between the hub 61 and the rib 66 along a radius of the circle. Each of the blocks 62 includes two slopes 64 and 65 and two flat faces 63 and 67. The flat face 63 is placed between the slopes 64 and 65. The slope 64 is shaped in compliance with the slope 55. The slope 65 is shaped in compliance with the slope 56 between the flat faces 52 and 53.

The disc 32 includes a protuberance 37 extending from an upper face. The protuberance 37 includes an aperture defined therein.

Figure 5:
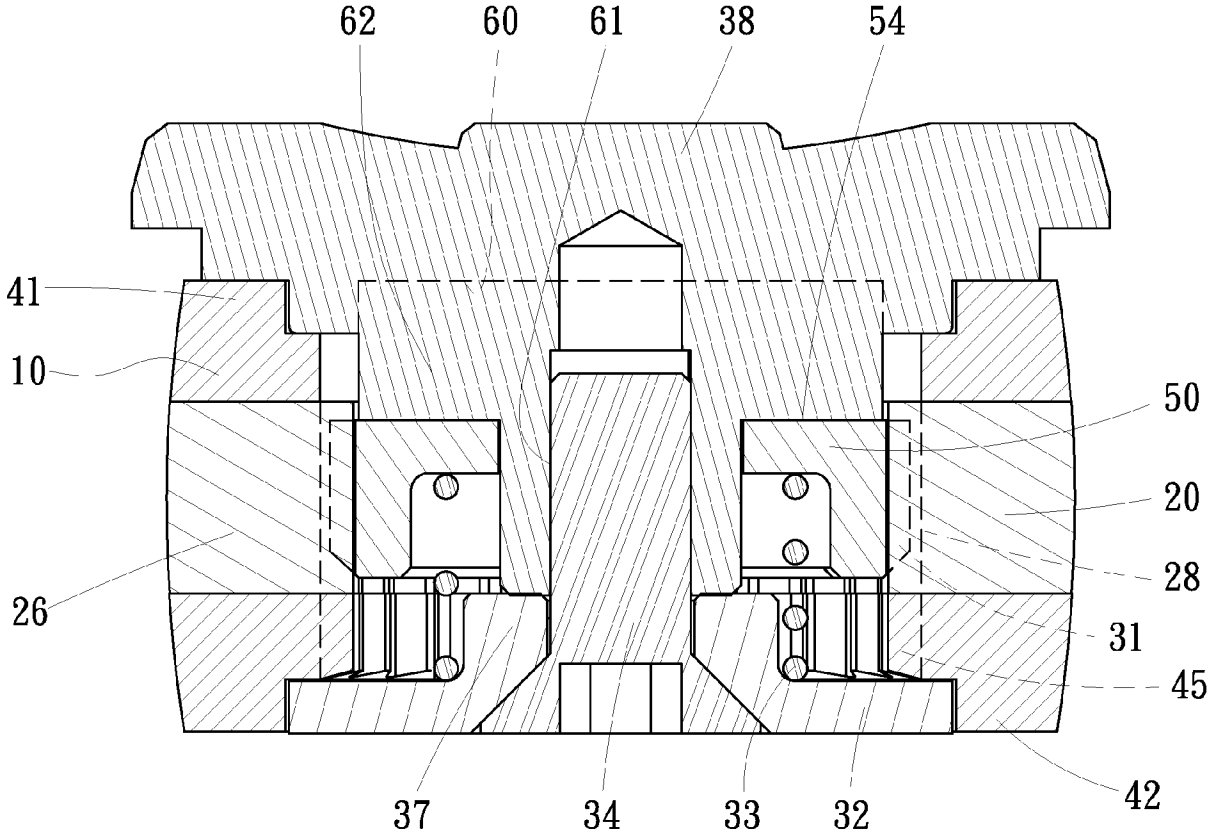
FIG. 5 is a cut-away view of the lock shown in FIG. 3 in a first position relative to the key shown in FIG. 4.

Referring to FIG. 5, the lug 26 is placed between the lugs 41 and 42. The disc 32 is placed in the opening 44 of the lug 42, with the upper face thereof placed against the shoulder between the openings 44 and 43 of the lug 42. The protuberance 37 is placed in the opening 43 of the lug 42. The spring 33 is placed on the disc 32 and around the protuberance 37. The lock 30 is placed in the lug 26, with the teeth 31 engaged with the teeth 28. The key 38 is placed on the lock 30. The hub 61 is inserted through the lock 30 and placed on the protuberance 37. The rib 66 is placed in the opening 43 of the lug 41 while the disc 60 is placed in the opening 44 of the lug 41. The disc 60 is placed against the shoulder between the openings 43 and 44 of the lug 41. The screw 34 is driven in a screw hole defined in the hub 61 through the disc 32, the spring 33 and the lock 30. The lock 30 is biased toward the key 38 by the spring 33. Thus, the foldable wrench is assembled.

Figure 6:
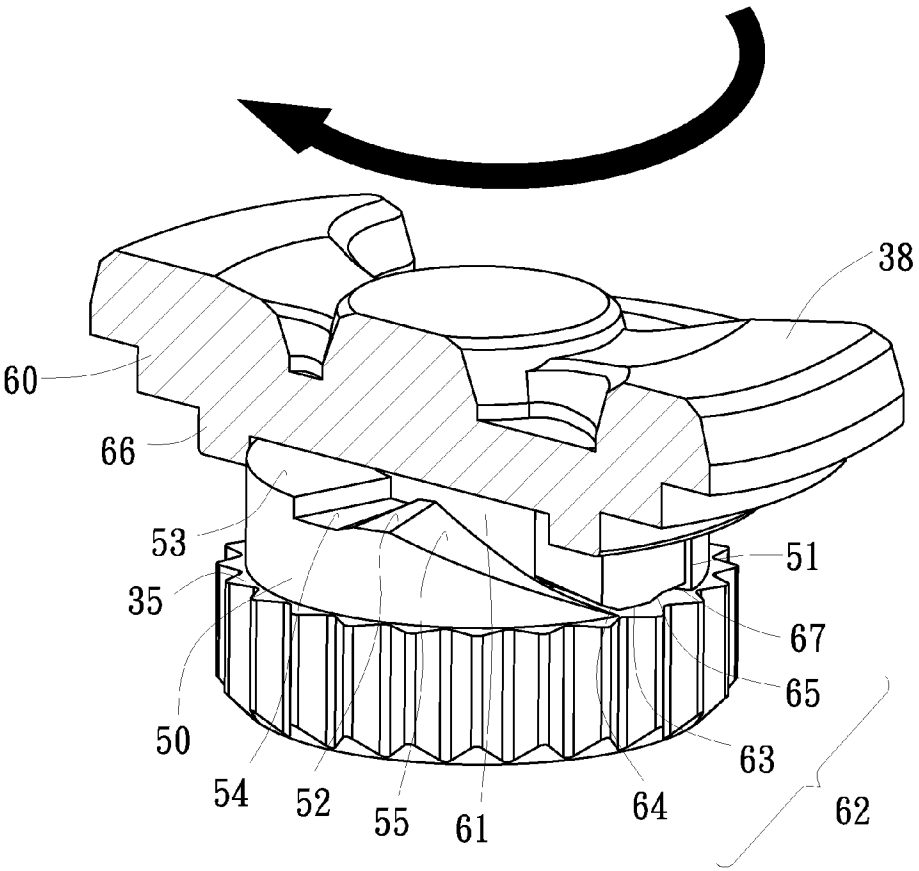
FIG. 6 is a cross-sectional view of the foldable wrench of FIG. 5.

Referring to FIGS. 5 and 6, the lock 30 is placed in an upper position where it is placed above the lug 42. That is, the teeth 31 are not engaged with the teeth 45. Thus, the lever 10 is allowed to pivot relative to the handle 20.

Figure 7:
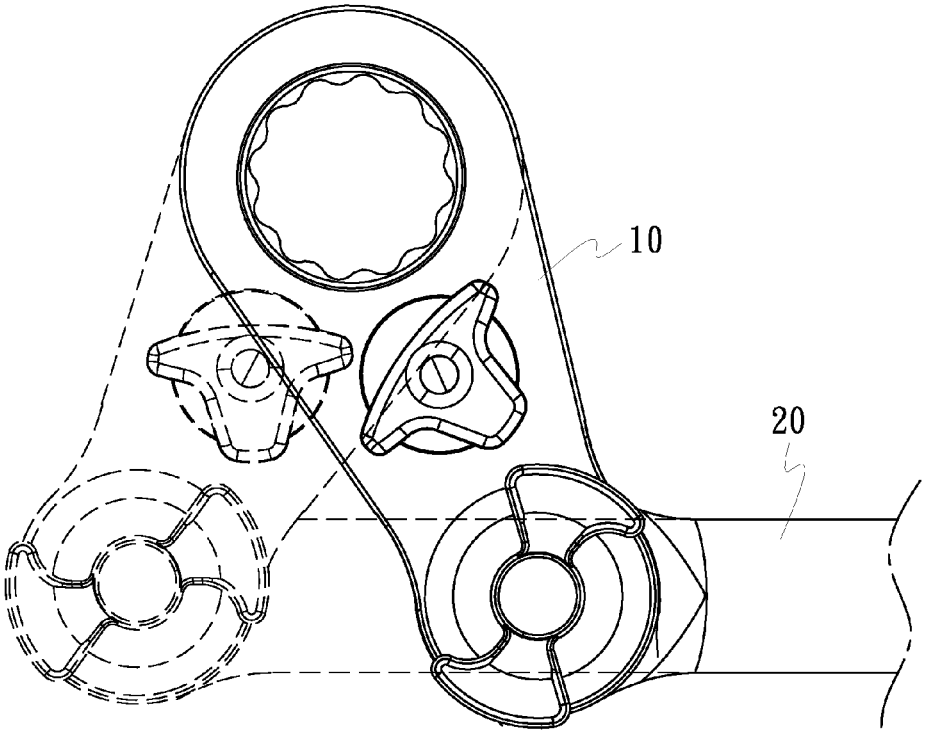
FIG. 7 is a top view of the foldable wrench shown in FIG. 6.

Referring to FIG. 7, the handle 20 is pivoted relative to the lever 10 about a first axis. With the selectively one-way rotating unit, the gear 11 is rotated together with or relative to the lever 10 about a second axis extending parallel to the first axis. The pivoting of the handle 20 relative to the lever 10 about the first axis can be executed to bring about the pivoting of the lever 10 about the second axis. That is, the handle 20 can be substantially moved to and fro to pivot the lever 10 to and fro. In some limited spaces, this is very useful. Therefore, the handle 20 does not have to be pivoted for a large angle to have the lever 10 pivoted for a large angle, and this is convenient in a limited space.

Figure 8:
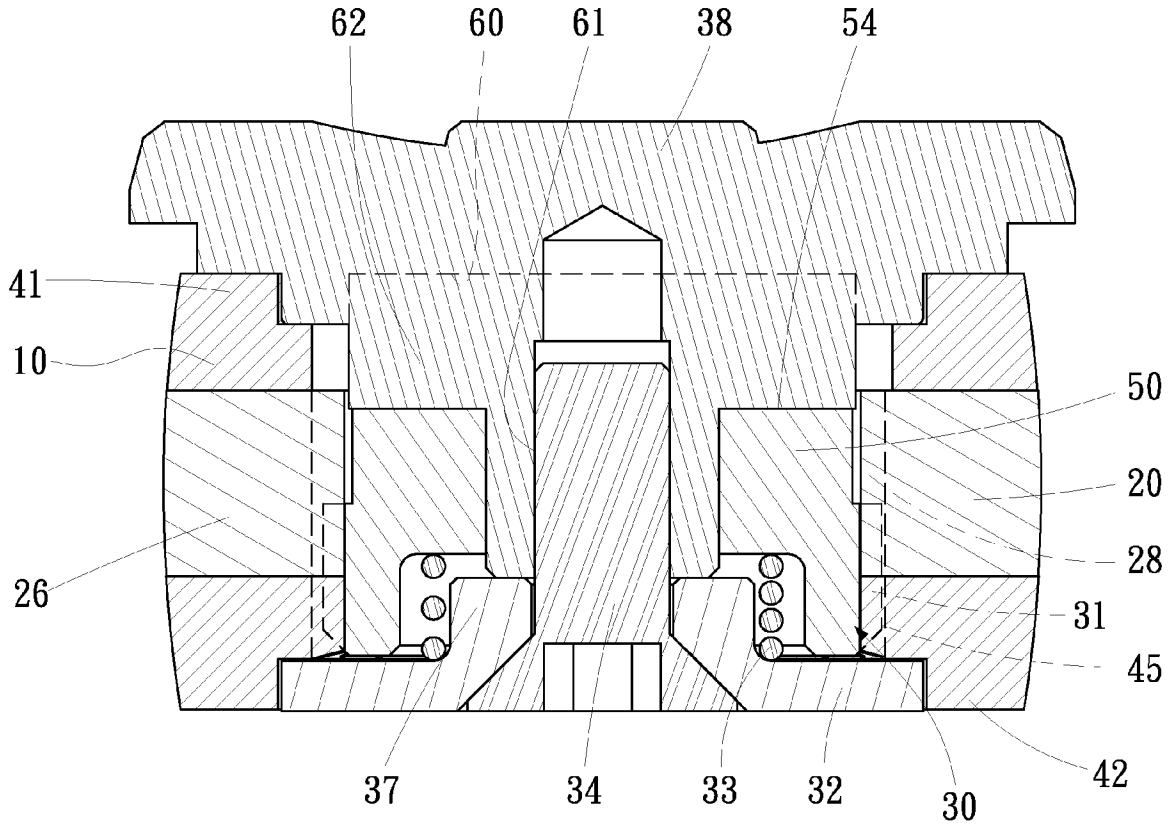
FIG. 8 is a cut-away view of the lock shown in FIG. 3 in a second position relative to the key shown in FIG. 4.
Figure 9:
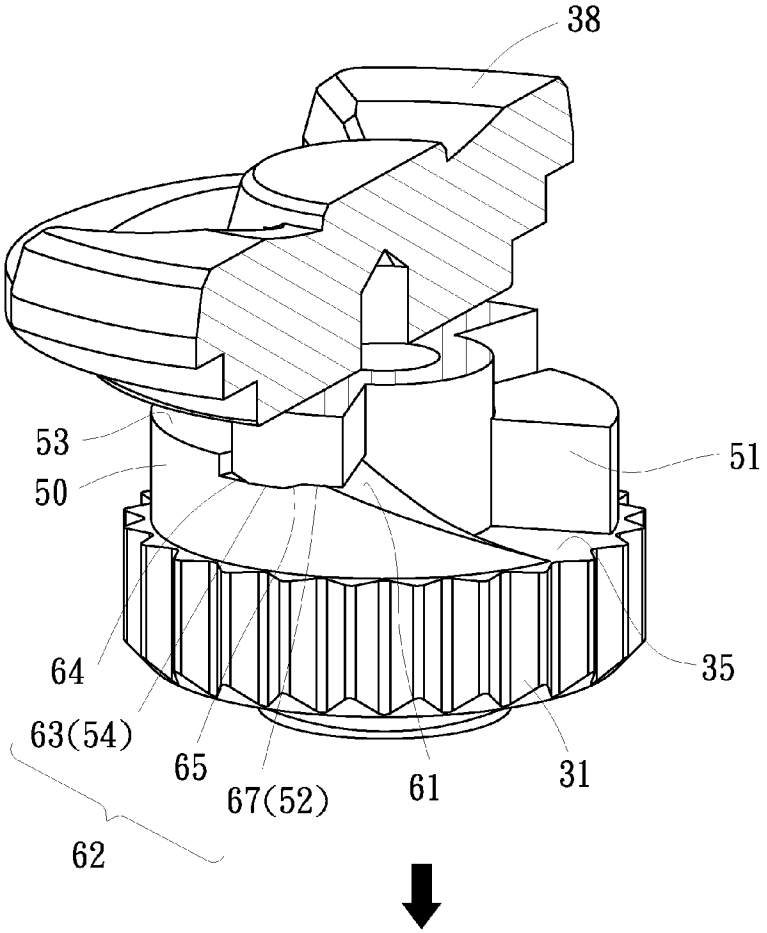
FIG. 9 is a cross-sectional view of the foldable wrench in another position than shown in FIG. 8.

The key 38 can be turned on the lock 30 in a first direction. The slopes 64 slide on the slopes 55 so that the key 38 pushes the lock 30 from the upper position shown in FIGS. 5 and 6 to a lower position referring to FIGS. 8 and 9 where the lock 30 is placed in the lug 42. That is, the teeth 31 are engaged with the teeth 45. Thus, the lever 10 is prevented from pivoting relative to the handle 20. In the lower position, the flat face 63 is in tight contact with the flat face 54, and the slope 63 is in tight contact with the slope 56 because the lock 30 is biased to the key 38 by the spring 33. A boss between the slopes 64 and 65 is kept in a recess between the flat faces 52 and 53. Hence, the lock 30 is retained in the lower position.

The key 38 can be turned on the lock 30 in a second direction to allow the spring 33 to push the lock 30 back to the upper position from the lower position. The slopes 56 can slide on the slopes 65 to facilitate the rotation of the key 38 on the lock 30 in the second direction.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A foldable wrench including:

a lever including a first lug with an opening defined therein and teeth formed on the wall of the opening and a second lug with an opening defined therein;

a handle including a lug including an opening defined therein and teeth formed on the wall of the opening, wherein the lug of the handle is placed between the first and second lugs of the lever;

a lock including teeth formed thereon, wherein the lock is movable between a releasing position to engage the teeth of the lock with the teeth of the handle only and a locking position to engage the teeth of the lock with the teeth of the handle and the teeth of the lever; and a key rotatable on the second lug of the lever between a first position corresponding to the releasing position and a second position corresponding to the locking position.

2. The foldable wrench according to claim 1, wherein the lock includes two wedges formed thereon, wherein the key includes two blocks for sliding on the wedges to move the lock between the releasing and locking positions.

3. The foldable wrench according to claim 2, further including a spring for biasing the lock toward the releasing position from the locking position.

4. The foldable wrench according to claim 3, further including a disc connected to the first lug of the lever, wherein the spring is biased between the disc and the lock.

5. The foldable wrench according to claim 4, further including a screw driven in the key through the disc, the spring and the lock.

6. The foldable wrench according to claim 5, wherein the key includes a hub for receiving the screw.

7. The foldable wrench according to claim 4, wherein the first lug of the lever further includes another opening for receiving the disc so that the disc is flush with the first lug of the lever.

8. The foldable wrench according to claim 1, wherein the key includes a disc placed on the second lug of the lever.

9. The foldable wrench according to claim 8, wherein the second lug of the lever further includes another opening for receiving the disc so that the disc is flush with the second lug of the lever.

10. The foldable wrench according to claim 1, wherein each of the wedges includes a first slope formed thereon, wherein each of the blocks includes a first slope for sliding on the first slope of a corresponding one of the wedges.

11. The foldable wrench according to claim 10, wherein each of the blocks further includes a second slope and a flat face between the first and second slopes thereof, wherein each of the wedges further includes a first flat face, a second flat face and a third flat face, wherein the second flat face is placed lower than the first and third flat faces to define a recess for receiving a boss formed between the first and second slopes and of the corresponding block.

12. The foldable wrench according to claim 11, wherein each of the wedges further includes a second slope for sliding on the second slope of the corresponding block to facilitate the rotation of the key on the lock from the second position to the first position.

* * * * *